United States Patent [19]

Umetani

[11] Patent Number: 4,990,960

[45] Date of Patent: Feb. 5, 1991

[54] METHOD AND DEVICE FOR MEASURING DENSITIES OF DIFFERENT TONERS CONSTITUTING A MIXTURE

[75] Inventor: Yoshinobu Umetani, Nara, Japan

[73] Assignee: Mita Industrial Co., Ltd., Osaka, Japan

[21] Appl. No.: 491,026

[22] Filed: Mar. 9, 1990

[30] Foreign Application Priority Data

Mar. 10, 1989 [JP] Japan ..... 1-58939

[51] Int. Cl.[5] ..... G03G 21/00; G03G 15/01

[52] U.S. Cl. ..... 355/246; 118/645; 355/327

[58] Field of Search ..... 355/245, 246, 326, 327, 355/260; 118/645; 430/45, 109

[56] References Cited

U.S. PATENT DOCUMENTS

| | | | |
|---|---|---|---|
| 3,754,821 | 8/1973 | Whited | 355/246 X |
| 4,082,061 | 4/1978 | Fraser | 118/645 |
| 4,113,371 | 9/1978 | Fraser et al. | 355/326 |
| 4,506,973 | 3/1985 | Ernst | 355/246 X |

FOREIGN PATENT DOCUMENTS

| | | | |
|---|---|---|---|
| 0170755 | 9/1986 | Japan | 355/327 |
| 62-209560 | 9/1987 | Japan . | |
| 0114867 | 5/1989 | Japan | 355/326 |

*Primary Examiner*—Fred L. Braun
*Assistant Examiner*—William J. Royer
*Attorney, Agent, or Firm*—Armstrong, Nikaido, Marmelstein, Kubovcik & Murray

[57] ABSTRACT

Disclosed are a method of and a device for measuring different kinds of photosensitive toners each being sensitive to light with a different range of wavelengths and contained in a photosensitive toner mixture which is used for forming a color image by a single exposure and developing operation. One or more than one kind of light is selected from the different kinds of light having wavelengths to which the respective kinds of toners are sensitive, so as to be projected to the photosensitive toner mixture, so that one or more kinds of photosensitive toners sensitive to the projected light are discharged. The one or more kinds of discharged photosensitive toners are separated from the one or more kinds of charged photosensitive toners, and the amount of the charged photosensitive toners is measured. On the basis of the amount of each kind of photosensitive toner that is not sensitive to the projected light, the density of that photosensitive toner, or other photosensitive toners are determined.

12 Claims, 3 Drawing Sheets

METHOD AND DEVICE FOR MEASURING DENSITIES OF DIFFERENT TONERS CONSTITUTING A MIXTURE

BACKGROUND OF THE INVENTION

1. Field of the invention

The present invention relates to a method or and a device for measuring the densities of different kinds of photo-sensitive toners constituting a photo-sensitive toner mixture which is used to form a color image by a single exposure and developing operation, and more particularly to a method of and a device for measuring the densities of three kinds of photo-sensitive toners constituting a photo-sensitive toner mixture, the photo-sensitive toners being colored cyan, magenta, and yellow, respectively, and becoming conductive by being exposed to three kinds of light, respectively, each light having wavelengths in a color region complementary to the color of each toner.

2. Description of the prior art

In recent years, a method of forming a color image by a single exposure and developing operation using photo-sensitive toners has been attracting attention. This kind of color image forming method uses three kinds of photo-sensitive toners colored cyan, magenta, and yellow, respectively. The photo-sensitive toners are sensitive to the light of colors complementary to the respective toner colors, i.e., the cyan toner is sensitive to red light, the magenta toner to green light, and the yellow toner to blue light, each becoming conductive by being exposed to its complementary light. When electrically charged photo-sensitive toners are exposed to the respective kinds of light to which they are sensitive, they become conductive and lose their electrical charge (hereinafter referred to as "discharged").

The following describes an example of the above color image forming method using photo-sensitive toners of different colors. First, a mixture of the above three kinds of photo-sensitive toners is uniformly charged, and then, light that contains information of a color image is projected onto the photoconductive toner mixture. For example, green light is projected to the areas on the photo-sensitive toner mixture that correspond to the green parts of the image to be formed, so that, in those areas, magenta toner sensitive to green light becomes conductive and is electrically discharged, while the yellow and cyan toners do not become conductive but remain charged. Likewise, the areas corresponding to the blue parts of the image are exposed to blue light, so that the yellow toner in those areas is discharged, while the cyan and magenta toners remain charged; with red light projected to the areas corresponding to red parts of the image, the cyan toner in those areas is discharged, but the magenta and yellow toners remain charged. Thereafter, the thus discharged photo-sensitive toners are separated from the charged photo-sensitive toners, and then the charged photo-sensitive toners are transferred onto copy paper to form a final color image thereon.

In the above method of forming a color image, however, all kinds of photo-sensitive toners are not equally consumed, but the consumption amount differs among the toners according to the color tone of the image to be formed. Therefore, as the image forming operation is repeated, the unevenness in the consumption of the photo-sensitive toners becomes greater, and there may arise, for example, a possibility of the ratio of one kind of toner to the whole photo-sensitive toner mixture (the toner density in the photoconductor toner mixture) decreasing. If the density of one kind of photo-sensitive toner decreases, the color produced with that photo-sensitive toner will not come out clear, thus impairing the quality of the final image produced.

Japanese Laid-Open Patent Publication No. 62-209560 discloses a method of measuring transferred amounts of different kinds of color toners. However, this method is not used for measuring different kinds of color toners constituting a color toner mixture, but it is only applicable to a color image forming method in which an exposure process and a developing process are performed for each kind of color toner and the resultant toner images are superimposed on each other to produce a final color image. Therefore, it is not applicable to the aforementioned method of forming a color image by a single exposure and developing operation using a mixture of different kinds of photo-sensitive toners.

SUMMARY OF THE INVENTION

The method of measuring photo-sensitive toner density of this invention, which overcomes the above-discussed and numerous other disadvantages and deficiencies of the prior art, is a method of measuring the densities of different kinds of photo-sensitive toners which constitute a photo-sensitive toner mixture and each of which becomes conductive by being exposed to a different kind of light, each light having a predetermined range of wavelengths, wherein said method comprises the steps of: uniformly charging said photo-sensitive toner mixture; selectively projecting different kinds of light onto the charged photo-sensitive toner mixture, said different kinds of light being of the wavelengths to which the respective kinds of photo-sensitive toners contained in said photo-sensitive toner mixture are sensitive; separating the discharged photo-sensitive toner from the charged photo-sensitive toners in the exposed photo-sensitive toner mixture; and determining the amount of said charged photo-sensitive toners.

In a preferred embodiment, the photo-sensitive toner mixture is charged by a carrier through friction, carried by a sleeve while being formed into a magnetic brush, and then applied to a transparent supporting body.

In a preferred embodiment, the charged photo-sensitive toner mixture on said transparent supporting body includes two areas, one being subjected to an exposure and developing process for the formation of image thereon, and the other being exposed to at least one of said different kinds of light.

In a preferred embodiment, the photo-sensitive toner which has been exposed and discharged is separated from said transparent supporting body by means of said magnetic brush on said sleeve.

In a preferred embodiment, the photo-sensitive toners are colored cyan, magenta, and yellow, respectively, each being sensitive to light with wavelengths in a region of a color complementary to the color thereof.

In a preferred embodiment, the photo-sensitive toner mixture is exposed to two kinds of light with wavelengths to which two kinds of photo-sensitive toners are sensitive, respectively.

In a further preferred embodiment, the photo-sensitive toner mixture is exposed to a single kind of light with wavelengths to which a single kind of photo-sensitive toner is sensitive.

The device for measuring photo-sensitive toner density of this invention, is a device for measuring the densities of different kinds of photo-sensitive toners which constitute a photo-sensitive toner mixture and each of which becomes conductive by being exposed to a different kind of light, each light having a predetermined range of wavelengths, wherein said device comprises: a means for uniformly charging said photo-sensitive toner mixture; a light source for selectively projecting different kinds of light onto the charged photo-sensitive toner mixture, said different kinds of light being of wavelengths to which the respective kinds of photo-sensitive toners contained in the photo-sensitive toner mixture are sensitive; a means for separating the discharged photo-sensitive toner from the charged photo-sensitive toners in the photo-sensitive toner mixture exposed by said light source; and a toner amount detector for determining the amount of said charged photo-sensitive toners.

In a preferred embodiment, the above-mentioned device for measuring photo-sensitive toner density further comprises a mixing chamber containing carrier for charging said photo-sensitive toners through friction.

In a preferred embodiment, the mixing chamber has a sleeve therein for carrying said charged photo-sensitive toners while forming a magnetic brush from said charged photo-sensitive toners and said carrier, so as to allow said charged photo-sensitive toner mixture to be applied to a transparent supporting body.

In a preferred embodiment, the light source is so located as to project light through said transparent supporting body to said charged photo-sensitive toner mixture held on said transparent supporting body.

In a preferred embodiment, the separating means consists of said sleeve, the magnetic brush on which is used to separate said discharged photo-sensitive toner from said transparent supporting body.

Thus, the method of and the device for measuring photo-sensitive toner density according to the invention can readily and reliably measure the densities of different kinds of photo-sensitive toners constituting a photo-sensitive toner mixture. Furthermore, the method and the device of the invention can readily be applied to an apparatus for forming a color image by a single exposure and developing operation, thereby assuring constant production of a color image of vivid hues by the color image forming apparatus.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

A method of measuring photo-sensitive toner density according to the invention is used in a color image forming apparatus, which forms a color image by a single exposure and developing operation by using a photo-sensitive toner mixture consisting of three kinds of photo-sensitive toners, for example, cyan toner colored cyan which becomes conductive by being exposed to red light, magenta toner colored magenta which becomes conductive by being exposed to green light, and yellow toner colored yellow which becomes conductive by being exposed to blue light.

Figure 1:
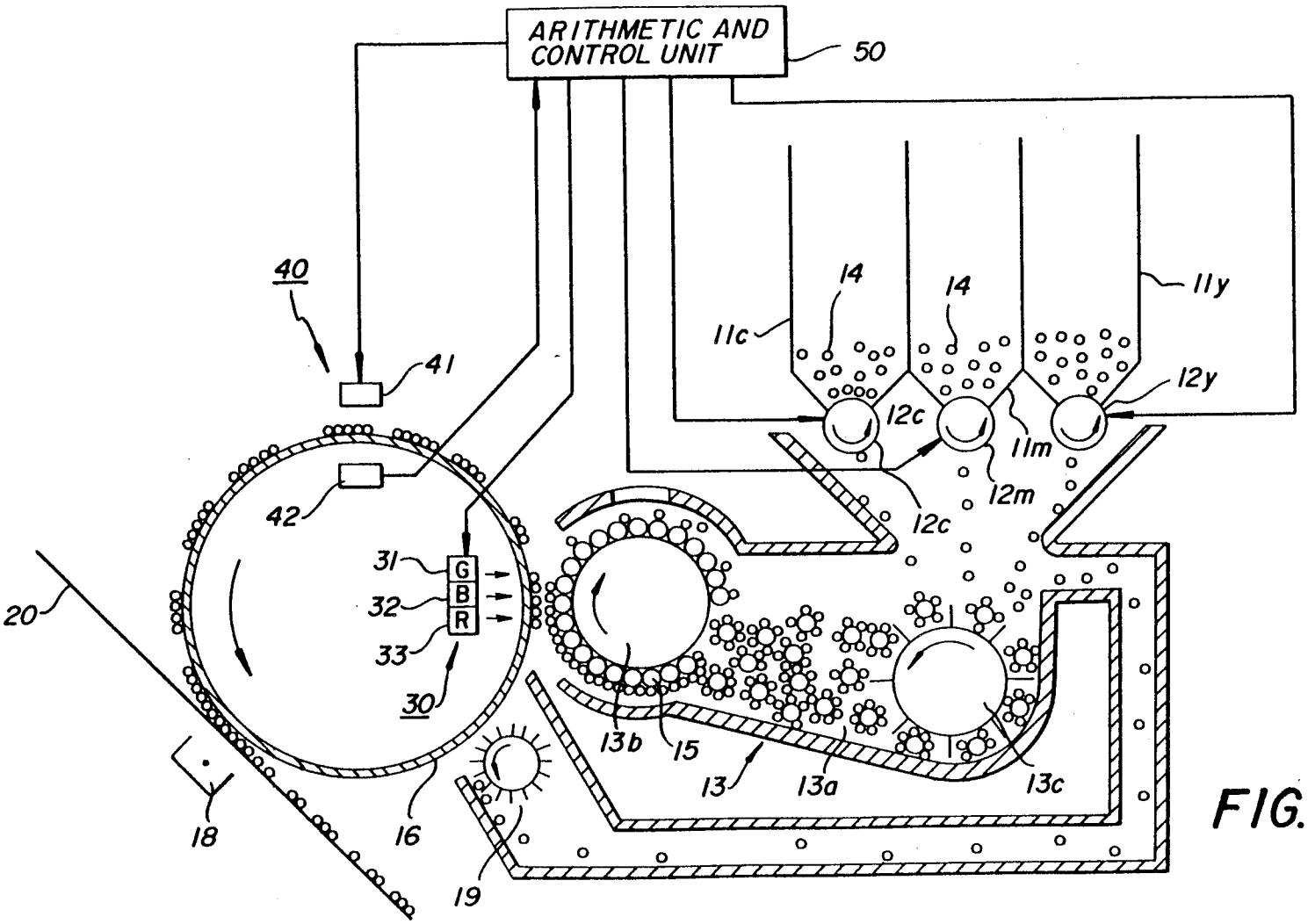
FIG. 1 is a schematic diagram of a color image forming apparatus using a device embodying a method of measuring photo-sensitive toner density according to the invention.

FIG. 1 is a schematic diagram showing such a color image forming apparatus which uses a device embodying the method of this invention. The image forming apparatus has toner hoppers 11*c*, 11*m*, and 11*y* containing the cyan, magenta, and yellow toners, respectively. These photo-sensitive toners 14 contained in the respective toner hoppers 11*c*, 11*m*, and 11*y* are supplied to a mixing container 13 by means of toner feed rollers 12*c*, 12*m*, and 12*y*, respectively. The mixing container 13 has a mixing chamber 13*a* in the lower part thereof, and a sleeve 13*b* and a stirrer 13*c* are disposed in the mixing chamber 13*a*. The mixing chamber 13*a* contains carrier 15. The photo-sensitive toners 14 fed into the mixing chamber 13*a* and the carrier 15 already contained therein are stirred together by means of the stirrer 13*c*, thereby charging the toners 14 through friction. In one side of the mixing chamber 13*a*, a sleeve 13*b* is rotatably mounted. The photo-sensitive toners 14 thus charged through friction in the mixing chamber 13*a* are fed, together with the carrier 15, to the sleeve 13*b*. Then, photo-sensitive toners 14 and the carrier 15 form a magnetic brush while being carried on the circumferential surface of the sleeve 13*b* by the rotation thereof. A bias voltage of predetermined polarity is applied to the sleeve 13*b*.

Adjacent to the side of the mixing chamber 13*a*, a transparent electrically-conductive support drum 16 is rotatably mounted facing the sleeve 13*b* disposed inside the mixing chamber 13*a*. The conductive support drum 16 rotates in such a manner that the surface thereof moves in the same direction as the surface of the sleeve 13*b* at the position where the support drum 16 and the sleeve 13*b* face each other. The conductive support drum 16 is either provided with a voltage or grounded so as to give a potential difference with respect to the sleeve 13*b*, and accordingly an electric field is applied between them.

The following describes an example of the color image forming method using such an image forming apparatus.

As described above, the photo-sensitive toners 14 which have been charged in the mixing chamber 13*a* forms a magnetic brush on the sleeve 13*b* together with the carrier 15, and the magnetic brush thus formed contacts the support drum 16. At this time, since an electric field is applied between the support drum 16 and the sleeve 13*b*, a layer of photo-sensitive toner mixture consisting of the cyan, magenta, and yellow toners is formed on the support drum 16. Slit exposure is performed to expose the layer of the photo-sensitive toner mixture through the transparent support drum 16. In the slit exposure, green light is projected through the support drum 16 onto the areas of the charged photo-sensitive toner mixture that correspond to the green parts of the image to be formed, causing the magenta toner in the photo-sensitive toner mixture in those areas to become conductive and to be electrically discharged, while the Yellow and cyan toners remain charged without becoming conductive. Likewise, blue light is projected onto the areas of the charged photo-sensitive toner mixture that correspond to the blue parts of the image, causing the yellow toner in those areas to become conductive and to be discharged, while the cyan and magenta toners remain charged without becoming conductive. Further, red light is projected onto the areas of the charged photo-sensitive toner mixture that correspond to the red parts of the image, causing the cyan toner in those areas to become conductive and to be discharged, while the magenta and yellow toners remain charged. The photo-sensitive toners which have been discharged are attracted to the magnetic brush on the sleeve 13*b*. That is, in the areas of the support drum 16 onto which green light has been projected, the yellow and cyan toners are held on the support drum 16. Likewise, in the areas of the support drum 16 onto which blue light has been projected, the cyan and magenta toners are held on the support drum 16, and further, in the areas of the support drum 16 onto which red light has been projected, the magenta and yellow toners are held on the support drum 16.

The charged photo-sensitive toners held on the support drum 16 are carried thereon to the position at which the support drum 16 faces a transfer device 18, where they are transferred onto copy paper 20 by means of the transfer device 18 to which a voltage of predetermined polarity is applied. At this time, the yellow and cyan toners adhering to the areas on the support drum 16 exposed to green light are transferred to the copy paper 20 to impart green color. Likewise, the cyan and magenta toners adhering to the areas on the support drum 16 exposed to blue light are transferred to the copy paper 20 to give blue color, and further, the magenta and yellow toners adhering to the areas on the support drum 16 exposed to red light are transferred to the copy paper 20 to give red color, thus forming a desired full-color image on the copy paper 20. Thereafter, the surface area of the support drum 16 that has passed through the region where the support drum 16 and the transfer device 18 face each other is cleaned by a cleaning device 19 to remove the photo-sensitive toners 14 remaining thereon, which are supplied to the mixing container 13 for reuse.

A light source unit 30 is disposed inside the support drum 16 so as to face the sleeve 13*b* in the mixing chamber 13*a* across the support drum 16, and is also located outside the region where the above-mentioned slit exposure is performed. The light source unit 30 comprises three light sources capable of emitting light of respective wavelengths to which the respective photo-sensitive toners in the photo-sensitive toner mixture are sensitive, i.e., a green light source 31, a blue light source 32, and a red light source 33. The color light sources 31, 32, and 33 of the light source unit 30 project their respective light onto a non-image area on the support drum 16. In the measurement of toner density, two light sources are selected from the light sources 31 to 33 to project two kinds of light through the transparent support drum 16 onto the photo-sensitive toner mixture adhering to the non-image area on the support drum 16.

A toner amount detector 40 is disposed downstream in the rotating direction of the support drum 16 from the position where the support drum 16 faces the sleeve 13*b* and is exposed to the light from the light source unit 30. The toner amount detector 40 comprises a light emitting element 41 and a light receiving element 42 disposed facing each other across the non-image area of the support drum 16 where no image is formed. The light emitting element 41 emits, for example, infrared radiation toward the light receiving element 42. The light emitted from the light emitting element 41 is first directed to the support drum 16, and then only the portions of the light which have impinged upon the portions of the support drum 16 having no photo-sensitive toners thereon pass through the support drum 16 to be received by the light receiving element 42. The light receiving element 42 then outputs a signal corresponding to the amount of the light it has received.

The signal output from the light receiving element 42 is given to an arithmetic and control unit 50. In accordance with the detected result of the light receiving element 42, the arithmetic and control unit 50 outputs signals to the driving sources of the toner feed rollers 12*c*, 12*m*, and 12*y* disposed at the bottom of the toner hoppers 11*c*, 11*m*, and 11*y* containing cyan, magenta, and yellow toners, respectively, so as to drive the toner feed rollers 12*c*, 12*m*, and 12*y* in accordance with the respective output signals. In this way, the arithmetic and control unit 50 selectively drives the toner feed rollers 12*c*, 12*m*, and 12*y*. The arithmetic and control unit 50 also outputs signals to the green light source 31, the blue light source 32, and the red light source 33 of the light source unit 30, and to the light emitting element 41.

Figure 2:
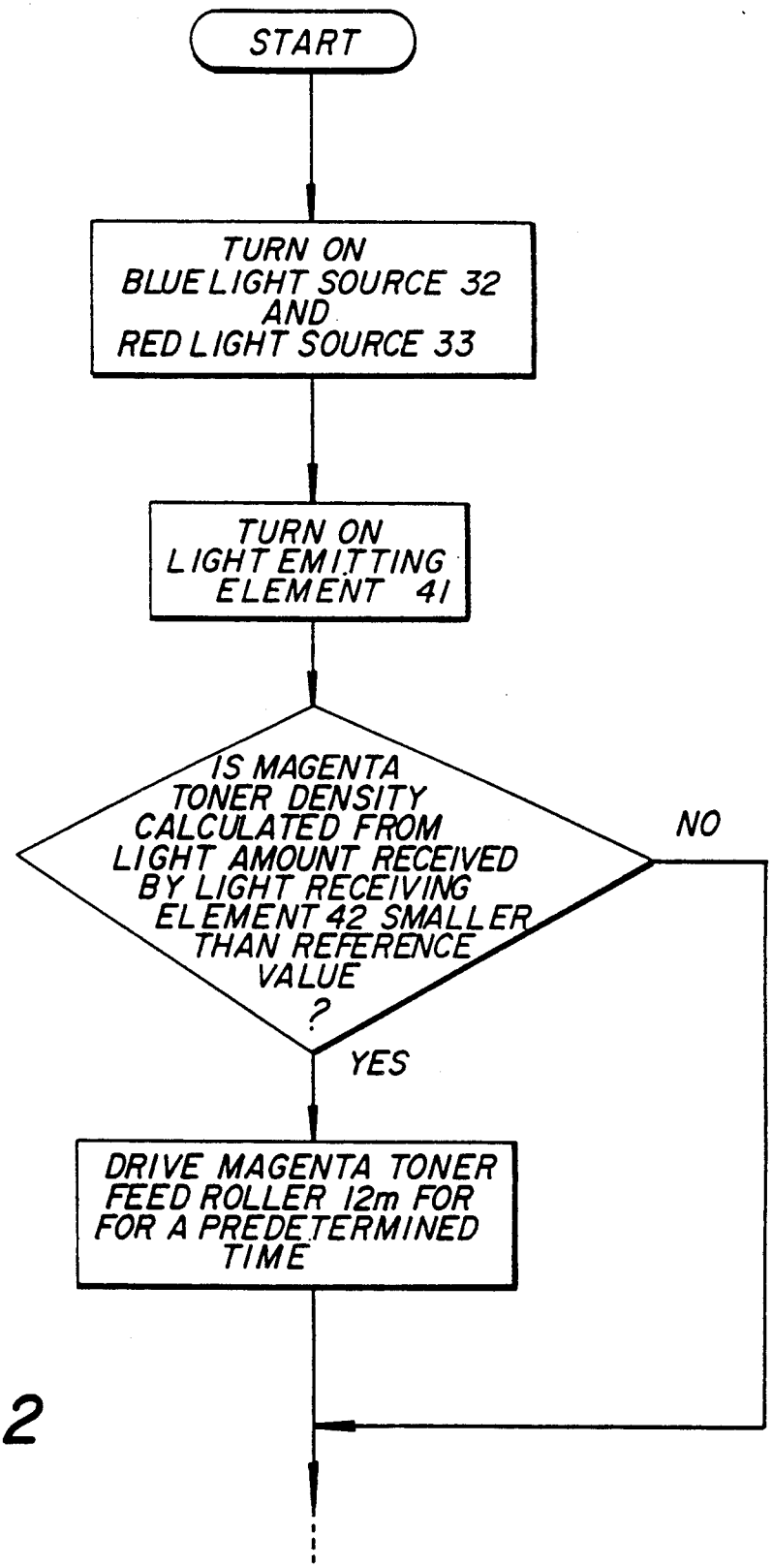
FIG. 2 is a flowchart showing the control operation performed by an arithmetic and control unit which is used in the color image forming apparatus.

Next, the control operation of the arithmetic and control unit 50 in the measurement of the toner density is described with reference to a flowchart shown in FIG. 2. For example, prior to the process for forming a given color image, the arithmetic and control unit 50 controls the density of each kind of photo-sensitive toner in the photo-sensitive toner mixture by measuring the density of each kind of photo-sensitive toner in the photo-sensitive toner mixture.

First, the arithmetic and Control unit 50 turns on two light sources of the light source unit 30, for example, the blue light source 32 and the red light source 33, to expose the charged photo-sensitive toner mixture in non-image area on the support drum 16 to blue and red light through the transparent support drum 16. By doing this, the yellow and cyan toners in the photo-sensitive toner mixture become conductive and are discharged, and move toward the magnetic brush on the sleeve 13*b*. As a result, only the magenta toner is held on the support drum 16.

When the portions of the support drum 16 holding the magenta toner reach the position between the light emitting element 41 and the light receiving element 42 of the toner amount detector 40, the arithmetic and control unit 50 turns on the light emitting element 41 and reads the signal output from the light receiving element 42. The light emitted from the light emitting element 41 is only allowed to pass through the portions of the transparent support drum 16 where no magenta toner is held, so that only the part of light which has passed through those portions is received by the light receiving element 42. Therefore, the amount of light received by the light receiving element 42 is inversely proportional to the amount of the magenta toner adhering to the support drum 16, that is, as the amount of the magenta toner increases, the amount of light to be received by the light receiving element 42 decreases. The light receiving element 42 provides the arithmetic and control unit 50 with a signal corresponding to the amount of the light it has received.

The arithmetic and control unit 50 calculates the amount of the magenta toner on the basis of the amount of received light detected by the light receiving element 42, and then compares the calculated magenta toner amount with a predetermined reference value of the magenta toner density. When the amount of magenta toner is smaller than the reference value, the arithmetic and control unit 30 outputs a prescribed signal to the driving source of the toner feed roller 12*m* at the bottom of the toner hopper 11*m* containing magenta toner, so as to drive the toner feed roller 12*m* for a predetermined period of time. This causes the toner feed roller 12*m* to feed magenta toner from the magenta toner hopper 11*m* to the mixing chamber 13*a*, thereby increasing the amount of the magenta toner in the mixing chamber 13*a*.

After the measurement of the magenta toner density, the densities of the cyan and yellow toners are successively measured in the same manner as described above.

In the measurement of the cyan toner density, the arithmetic and control unit 50 turns on the green light source 31 and the blue light source 32 of the light source unit 30 to discharge the magenta and yellow toners in the charged photo-sensitive toner mixture in the non-image area on the support drum 16, thus allowing only the cyan toner to be held on the support drum 16. Then, the amount of the cyan toner adhering to the support drum 16 is calculated on the basis of the detected result by the light receiving element 42 of the toner amount detector 40. When the calculated amount is smaller than a predetermined reference value of the cyan toner density, the toner feed roller 12*c* disposed at the bottom of the cyan toner hopper 11*c* is driven for a predetermined period of time.

Thereafter, for the measurement of yellow toner density, the arithmetic and control unit 50 further turns on the green light source 31 and the red light source 33 of the light source unit 30 to discharge the magenta and cyan toners in the charged photo-sensitive toner mixture in the non-image area on the support drum 16, thus allowing only the yellow toner to be held on the support drum 16. Then, the amount of the yellow toner held on the support drum 16 is calculated on the basis of the detected result by the light receiving element 42 of the toner amount detector 40. When the calculated amount of the yellow toner is smaller than a predetermined reference value of the yellow toner density, the toner feed roller 12*y*disposed at the bottom of the yellow toner hopper 11*y* is driven for a predetermined period of time.

The density of each toner contained in the photo-sensitive toner mixture consisting of magenta, cyan, and yellow toners and carried on the sleeve 13*b* is thus measured, and on the basis of the detected results, these three kinds of toners are selectively fed to the mixing chamber 13*a* so that all kinds of toners will have approximately equal density. With all kinds of toners in the mixing chamber 13*a* having approximately equal density, the color image forming process is performed, thus assuring the continued formation of a color image of vivid hues on the copy paper 20.

Figure 3:
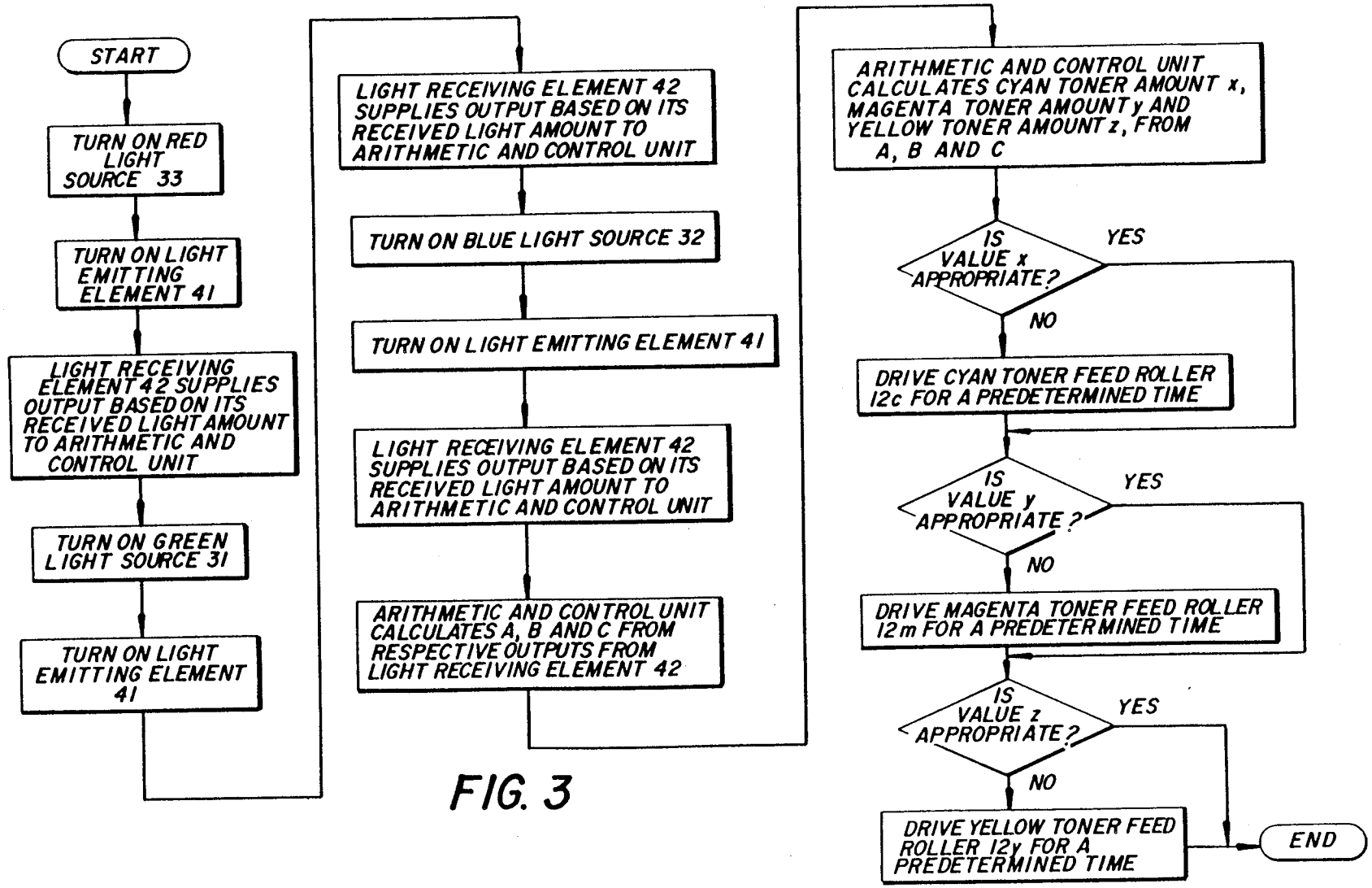
FIG. 3 is a flowchart showing the control operation in another embodiment of the invention.

FIG. 3 is a flowchart showing another example of the present invention, in which the arithmetic and control unit 50 turns on only one light source of the light source unit 30 at a time. For example, only the red light source 33 is turned on to expose the charged photo-sensitive toner mixture in the non-image area on the transparent support drum 16 to red light. By doing this, the cyan toner in the photo-sensitive toner mixture becomes conductive and is discharged, and moves toward the magnetic brush on the sleeve 13*b*, thereby leaving the magenta and yellow toners held on the support drum 16. Then, the toner amount detector 40 operates in the same manner as in the above-described embodiment, and thereafter, on the basis of the detected result by the light receiving element 42 of the toner amount detector 40, the combined amount (denoted as A) of the magenta and yellow toners held on the support drum 16 is calculated.

Next, the arithmetic and control unit 50 turns on only the green light source 31 of the light source unit 30 to discharge the magenta toner in the charged photo-sensitive toner mixture in the non-image area on the support drum 16, thus leaving the yellow and cyan toners held on the support drum 16. Then, on the basis of the detected result by the light receiving element 42 of the toner amount detector 40, the combined amount (denoted as B) of the yellow and cyan toners held on the support drum 16 is calculated.

Thereafter, the arithmetic and control unit 50 further turns on only the blue light source 32 of the light source unit 30 to discharge the yellow toner in the charged photo-sensitive toner mixture in the non-image area on the support drum 16, thus leaving the cyan and magenta toners held on the support drum 16. Then, on the basis of the detected result by the light receiving element 42 of the toner amount detector 40, the combined amount (denoted as C) of the cyan and magenta toners held on the support drum 16 is calculated.

The arithmetic and control unit 50 then calculates the amount of each of the cyan, magenta, and yellow toners from the above calculation results A, B and C.

For example, when the cyan toner amount is denoted as x, the magenta toner amount as y, and the yellow toner amount as z, the following equations are given.

$$x+y=C$$

$$y+z=A$$

$$z+x=B$$

From the above equations, x, y and z are calculated as follows:

$$x=(B+C-A)/2$$

$$y=(C+A-B)/2$$

$$z=(A+B-C)/2$$

In this way, the toner amounts x, y and z are obtained from the above calculation results A, B, and C.

Each of the thus obtained toner amounts is compared with the predetermined reference value of the toner density concerned, and when the amount is smaller than the reference value, the corresponding toner feed roller 12*c*, 12*m*, or 12*y* disposed at the bottom of the hoppers 11*c*, 11*m*, or 11*y* is driven for a predetermined period of time.

As the photo-sensitive toners to be measured by the method and the device of the present invention, particles made from compounds having photoconductive pigments dispersed in an electrically-insulating resin fixing medium are used. The photoconductive pigments include, for example, zinc oxide, cadmium sulfide (CdS), and other inorganic photoconductors, or perylene pigments, quinacridone pigments, diazo pigments, triazo pigments, and other photoconductive organic pigments. It is preferable that 3 to 600 parts by weight of the photoconductive pigments, and more preferably 5 to 500 parts by weight thereof, are contained in every 100 parts by weight of the fixing medium. If the quantity of the photoconductive pigments decreases to a level below the above range, the image density and the toner sensitivity tend to drop. Conversely, if the quantity exceeds the above range, the charge-holding characteristics of the toner tend to deteriorate.

As the fixing medium, known electrically-insulating fixing resins can be used, which include, for example, polystyrene, styrene-acrylonitrile copolymer, acrylic resin, polycarbonate, polyarylate (i.e., polyester formed from bisphenol A and isophthalic or terephthalic acid), polyvinylbutyral, and polysulfone. Also, photoconductive resins such as polyvinylcarbazole, etc. can be used alone or in combination with the electrically-insulating resins.

When the photoconductive pigments that are not sensitive to the light with wavelengths in the visible spectrum are used, known dye sensitizers or chemical sensitizers may be added thereto.

Also, a charge carrying medium may be used as the fixing medium, with the above-mentioned photoconductive pigments dispersed therein as charge generating pigments, to allow the resultant dispersed system to be used as the photo-sensitive toner. The charge carrying medium is composed of the above-mentioned electrically-insulating resin combined with one or more charge carrying substances, such as polyvinylcarbazole, phenanthrene, N-ethylcarbazole, 2,5-diphenyl-1,3,4-oxadiazole, 2,5-bis(4-diethylaminophenyl)-1,3,4-oxadiazole, bis(diethylaminophenyl-1,3,6-oxadiazole), 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3- (4-diethylaminostyryl)-5-(4-diethylaminophenyl)-2-pyrazoline, p-diethylaminobanzaldehyde diphenylhydrazone, and other hole carrying substances, and 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxanthone, dinitroanthracene, dinitroacridine, dinitroanthraquinone, and other electron carrying substances. Generally, 100 to 200 parts by weight of the charge carrying substances are preferably contained, and more preferably 30 to 120 parts thereof are contained, in every 100 parts by weight of the resin.

Offset inhibitors such as wax, etc. and assistants such as pressure-fixing additives, etc. that are known may be added to the above-mentioned components of the photo-sensitive toner in accordance with known prescriptions.

In the photo-sensitive toners used in the above embodiments, styrene-acrylonitrile copolymer (manufactured by Mitsui Toatsu Chemical Co./trade name; PA525) is used as the electrically-insulating resin fixing medium, with zinc oxide dispersed therein as the photoconductive pigments, and as colorants for the respective color toners, fluorescein is contained in the yellow toner, cyanine dye in the cyan toner, and erythrosine B in the magenta toner.

In the above embodiments, the value of each measured toner density is compared with the predetermined reference value, but alternatively, it may be so arranged, for example, that the densities of the respective photo-sensitive toners are measured and compared with each other to replenish the kind of toner that has the lowest density.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method of measuring the densities of different kinds of photo-sensitive toners which constitute a photo-sensitive toner mixture and each of which becomes conductive by being exposed to a different kind of light, each light having a predetermined range of wavelengths, wherein said method comprises the steps of:

uniformly charging said photo-sensitive toner mixture;

selectively projecting different kinds of light onto the charged photo-sensitive toner mixture, said different kinds of light being of the wavelengths to which the respective kinds of photo-sensitive toners contained in said photo-sensitive toner mixture are sensitive;

separating the discharged photo-sensitive toner from the charged photo-sensitive toners in the exposed photo-sensitive toner mixture; and determining the amount of said charged photo-sensitive toners.

2. A method according to claim 1: wherein said photo-sensitive toner mixture is charged by a carrier through friction, carried by a sleeve while being formed into a magnetic brush, and then applied to a transparent supporting body.

3. A method according to claim 2, wherein said charged photo-sensitive toner mixture on said transparent supporting body includes two areas, one being subjected to an exposure and developing process for the formation of image thereon, and the other being exposed to at least one of said different kinds of light.

4. A method according to claim 3, wherein said photo-sensitive toner which has been exposed and discharged is separated from said transparent supporting body by means of said magnetic brush on said sleeve.

5. A method according to claim 1, wherein said photo-sensitive toners are colored cyan, magenta, and yellow, respectively, each being sensitive to light with wavelengths in a region of color complementary to the color thereof.

6. A method according to claim 5, wherein said photo-sensitive toner mixture is exposed to two kinds of light with wavelengths to which two kinds of photo-sensitive toners are sensitive, respectively.

7. A method according to claim 5, wherein said photo-sensitive toner mixture is exposed to a single kind of light with wavelengths to which a single kind of photo-sensitive toner is sensitive.

8. A device for measuring the densities of different kinds of photo-sensitive toners which constitute a photo-sensitive toner mixture and each of which becomes conductive by being exposed to a different kind of light, each light having a predetermined range of wavelengths, wherein said device comprises:

a means for uniformly charging said photo-sensitive toner mixture;

a light source for selectively projecting different kinds of light onto the charged photo-sensitive toner mixture, said different kinds of light being of wavelengths to which the respective kinds of photo-sensitive toners contained in the photo-sensitive toner mixture are sensitive;

a means for separating the discharged photo-sensitive toner from the charged photo-sensitive toners in the photo-sensitive toner mixture exposed by said light source; and a toner amount detector for determining the amount of said charged photo-sensitive toners.

9. A device according to claim 8 which further comprises a mixing chamber containing carrier for charging said photo-sensitive toners through friction.

10. A device according to claim 9, wherein said mixing chamber has a sleeve therein for carrying said charged photo-sensitive toners while forming a magnetic brush from said charged photo-sensitive toners and said carrier, so as to allow said charged photo-sensitive toner mixture to be applied to a transparent supporting body

11. A device according to claim 10, wherein said light source is so located as to project light through said transparent supporting body to said charged photo-sensitive toner mixture held on said transparent supporting body.

12. A device according to claim 11, wherein said separating means consists of said sleeve, the magnetic brush on which is used to separate said discharged photo-sensitive toner from said transparent supporting body.

* * * * *